US012618603B2

(12) United States Patent
You et al.

(10) Patent No.: US 12,618,603 B2
(45) Date of Patent: May 5, 2026

(54) REFRIGERATOR

(71) Applicant: SAMSUNG ELECTRONICS CO., LTD., Suwon-si (KR)

(72) Inventors: Youngmin You, Suwon-si (KR); Ilsung Bae, Suwon-si (KR); Jinyoung Song, Suwon-si (KR); Byungkwan Yang, Suwon-si (KR); Sangjune Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 138 days.

(21) Appl. No.: 18/204,109

(22) Filed: May 31, 2023

(65) Prior Publication Data

US 2023/0304721 A1 Sep. 28, 2023

Related U.S. Application Data

(63) Continuation of application No. PCT/KR2021/014380, filed on Oct. 15, 2021.

(30) Foreign Application Priority Data

Dec. 7, 2020 (KR) ..... 10-2020-0169905

(51) Int. Cl.
*F25D 17/06* (2006.01)
*F25D 17/08* (2006.01)
*F25D 23/06* (2006.01)

(52) U.S. Cl.
CPC ..... *F25D 17/062* (2013.01); *F25D 17/08* (2013.01); *F25D 23/065* (2013.01); *F25D 2317/067* (2013.01)

(58) Field of Classification Search
CPC .. F25D 17/08; F25D 2317/067; F25D 17/062; F25D 17/067; F25D 17/065;
(Continued)

(56) References Cited

U.S. PATENT DOCUMENTS 3,923,355 A * 12/1975 Dietterich ..... B32B 15/046 312/406.1
4,920,765 A * 5/1990 McCauley ..... F25D 17/065 62/187
(Continued)

FOREIGN PATENT DOCUMENTS

CN 115717802 A * 2/2023
DE 102015203145 A1 * 8/2016 ..... F25D 17/062
(Continued)

OTHER PUBLICATIONS

JP2016118313 translation (Year: 2016).*
(Continued)

*Primary Examiner* — Hiwot E Tefera
(74) *Attorney, Agent, or Firm* — Sughrue Mion, PLLC

(57) ABSTRACT

A refrigerator includes an inner case defining a storage compartment; an outer case coupled to an outside of the inner case; and a duct mounted to the inner case and configured to provide a flow path to supply air to the storage compartment, wherein the inner case may include a first accommodating groove that is recessed toward the outer case, and one end of the duct is disposed in the first accommodating groove and is spaced apart from a surface of the first accommodating groove.

13 Claims, 8 Drawing Sheets

(58) Field of Classification Search
CPC ..... F25D 17/045; F25D 2317/0672; F25D 2317/063; F25D 2317/0671; F25D 23/065
See application file for complete search history.

(56) References Cited

U.S. PATENT DOCUMENTS

| | | | | | |
|---|---|---|---|---|---|
| 5,064,291 | A | | 11/1991 | Reiser | |
| 5,722,252 | A | * | 3/1998 | Kang | F25D 17/065 62/417 |
| 5,727,859 | A | | 3/1998 | Jeong et al. | |
| 5,819,552 | A | * | 10/1998 | Lee | F25D 17/065 62/407 |
| 6,112,542 | A | * | 9/2000 | Lee | F25D 17/065 62/451 |
| 7,866,182 | B2 | * | 1/2011 | Lim | F25D 17/062 62/411 |
| 10,317,124 | B2 | | 6/2019 | Hyun | |
| 10,378,811 | B2 | | 8/2019 | Lee et al. | |
| 2008/0048540 | A1 | | 2/2008 | Kim | |
| 2009/0308097 | A1 | * | 12/2009 | Gorz | F25D 17/062 62/407 |
| 2016/0273823 | A1 | * | 9/2016 | Cho | F25D 17/067 |
| 2017/0284724 | A1 | * | 10/2017 | Lee | F25B 5/02 |
| 2018/0224188 | A1 | * | 8/2018 | Lee | F25D 17/045 |
| 2020/0124339 | A1 | * | 4/2020 | Cheng | F25D 17/08 |
| 2020/0173709 | A1 | * | 6/2020 | Roh | F25D 21/08 |
| 2020/0370815 | A1 | | 11/2020 | Kim et al. | |
| 2021/0003339 | A1 | * | 1/2021 | Picanço | F25D 17/065 |
| 2021/0116162 | A1 | * | 4/2021 | Picanco | F25D 31/005 |

FOREIGN PATENT DOCUMENTS

| | | | | | |
|---|---|---|---|---|---|
| DE | 102019111156 | A1 | * | 10/2020 | F25D 25/02 |
| EP | 3 699 520 | A1 | | 8/2020 | |
| JP | H02242069 | A | * | 9/1990 | |
| JP | 2006-46793 | A | | 2/2006 | |
| JP | 2010-7870 | A | | 1/2010 | |
| JP | 2012-2395 | A | | 1/2012 | |
| JP | 2012-57941 | A | | 3/2012 | |
| JP | 2013-140013 | A | | 7/2013 | |
| JP | 2015-158333 | A | | 9/2015 | |
| JP | 2016-118313 | A | | 6/2016 | |
| KR | 10-1991-0018806 | A | | 11/1991 | |
| KR | 10-0142617 | B1 | | 8/1998 | |
| KR | 0169611 | B1 | * | 1/1999 | F25D 23/066 |
| KR | 100202117 | B1 | * | 6/1999 | |
| KR | 20010061677 | A | * | 7/2001 | |
| KR | 10-0833947 | B1 | | 5/2008 | |
| KR | 10-2008-0079109 | A | | 8/2008 | |
| KR | 10-1095891 | B1 | | 12/2011 | |
| KR | 10-1224657 | B1 | | 1/2013 | |
| KR | 10-2015-0072951 | A | | 6/2015 | |
| KR | 10-2019-0028037 | A | | 3/2019 | |

OTHER PUBLICATIONS

KR20150072951 translation (Year: 2015).*
JPH02242069 translation (Year: 1990).*
International Search Report dated Feb. 10, 2022, issued by the International Searching Authority in International Application No. PCT/KR2021/014380 (PCT/ISA/210).
Written Opinion dated Feb. 10, 2022, issued by the International Searching Authority in International Application No. PCT/KR2021/014380 (PCT/ISA/237).

* cited by examiner

REFRIGERATOR

CROSS-REFERENCE TO RELATED APPLICATIONS

This application is by-pass continuation application of International Application No. PCT/KR2021/014380, filed on Oct. 15, 2021, which based on and claims priority to Korean Patent Application No. 10-2020-0169905, filed on Dec. 7, 2020, in the Korean Intellectual Property Office, the disclosures of which are incorporated by reference herein in their entireties.

BACKGROUND

1. Field

The disclosure relates to a refrigerator having an improved structure.

2. Description of Related Art

In general, a refrigerator, which is an apparatus for keeping food fresh, is a home appliance provided to supply cold air to food by including a storage compartment for storing food and a cold air supply device for supplying cold air to the storage compartment.

The storage compartment is kept at a temperature within a constant range required to keep food fresh. The refrigerator has a cooling cycle for exchanging heat with intake air, and cool air generated by the cooling cycle is supplied to the storage compartment through a duct.

The duct is mounted on an inner case of the refrigerator to be exposed to a user, and accordingly, when the duct and the inner case are assembled, an assembly gap is inevitably generated.

SUMMARY

Provided are a refrigerator having an improved structure such that an assembly gap between a duct and an inner case is not exposed.

In addition, provided are a refrigerator having an inner case of an improved structure so as not to be affected by the design of a duct.

In addition, provided are refrigerator with improved aesthetics inside the refrigerator.

Additional aspects will be set forth in part in the description which follows and, in part, will be apparent from the description, or may be learned by practice of the presented embodiments.

According to an aspect of the disclosure, a refrigerator includes: an inner case defining a storage compartment; an outer case coupled to an outside of the inner case; and a duct mounted to the inner case and configured to provide a flow path to supply air to the storage compartment, wherein the inner case may include a first accommodating groove that is recessed toward the outer case, and one end of the duct is disposed in the first accommodating groove and is spaced apart from a surface of the first accommodating groove.

The duct may include a cover, and one end of the cover is disposed in the first accommodating groove.

A separation space may be provided between a front surface of the cover and an inner side surface of the first accommodating groove.

The cover may include: a front cover exposed to the storage compartment and forming a front exterior of the duct; and a support plate supporting the front cover.

The front cover may be configured to be detachable from the support plate.

The duct may further include a rear plate coupled to the support plate and configured to provide a portion of the flow path configured to supply the air between the rear plate and the support plate.

The cover may include a portion disposed in the first accommodating groove and not visible from the storage compartment.

The portion of the cover may be at an upper end of the cover.

The duct may be coupled to the inner case by a fastening member coupled at a rear of the inner case.

The duct may be mounted on a rear surface of the inner case and covers a central portion of the rear surface.

The duct may be mounted on a rear surface of the inner case and covers a majority of the rear surface.

The inner case may further include a second accommodating groove provided at a rear of the first accommodating groove.

The duct may include: a cover including an upper end disposed in the first accommodating groove; and a rear plate coupled to the cover and including an upper end portion disposed in the second accommodating groove.

The duct may be disposed in a vertical direction with respect to a bottom surface of the storage compartment.

An inner side surface of the first accommodating groove may be spaced apart from a front surface of the duct in a front-rear direction.

According to one or more embodiments, by making an assembly gap formed between a duct and an inner case invisible, the overall aesthetics inside a refrigerator can be improved.

According to one or more embodiments, because a part of the duct is inserted into an accommodating groove of the inner case, there is no need to spend extra time and effort to minimize the assembly gap between the duct and the inner case, and thus a production cycle can be improved.

According to one or more embodiments, because a separation space is secured between the accommodating groove of the inner case and the duct, it cannot be affected by changes in a front design of the duct.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
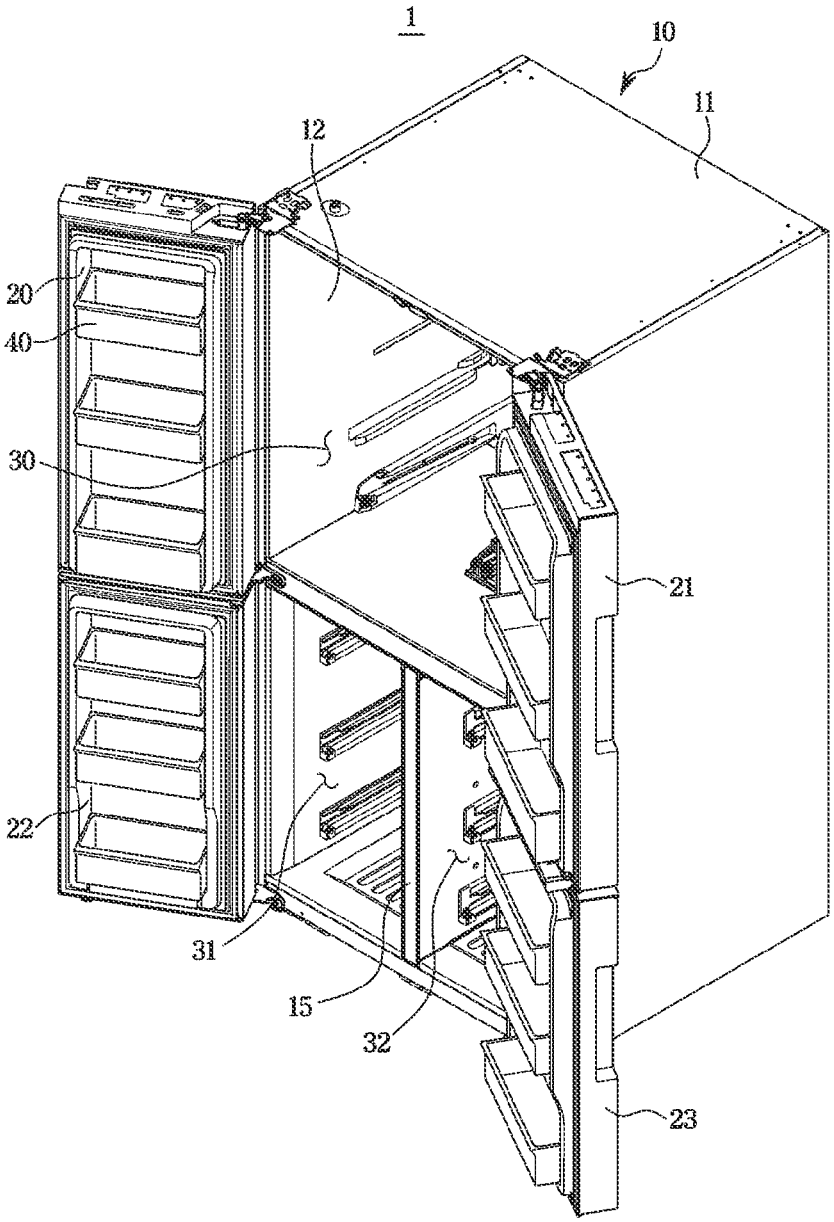
FIG. 1 is a perspective view of a refrigerator according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms, and these terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

Hereinafter, embodiments of the present disclosure will be described in detail with reference to the accompanying drawings.

FIG. 1 is a perspective view of a refrigerator according to an embodiment of the present disclosure.

As illustrated in FIG. 1, a refrigerator 1 may include a main body 10, and storage compartments, such as a first storage compartment 30, a second storage compartment 31, and a third storage compartment 32, provided inside the main body 10 and having an open front such that objects may be taken in and out.

The main body 10 may include an inner case 12 and an outer case 11. The outer case 11 may be provided to form an exterior of the refrigerator 1. The outer case 11 may be coupled to the outside of the inner case 12. The outer case 11 may be formed of a metal material having excellent durability and aesthetics. However, the material of the outer case 11 is not limited thereto.

The inner case 12 may be disposed inside the outer case 11. The inner case 12 may form a storage compartment. The inner case 12 may be made of a plastic material to be integrally injection molded.

A heat insulating material may be provided between the inner case 12 and the outer case 11 to secure insulation of the refrigerator 1.

The refrigerator 1 may include a plurality of the first storage compartment 30, the second storage compartment 31, and the third storage compartment 32. The storage compartments may include the first storage compartment 30, the second storage compartment 31, and the third storage compartment 32. In particular, the second storage compartment 31 and the third storage compartment 32 may be partitioned by a partition wall 15.

The first storage compartment 30 may be provided at an upper portion of the refrigerator 1, and the second storage compartment 31 and the third storage compartment 32 may be divided and provided at a lower portion of the refrigerator 1. However, a shape and number of the first storage compartment 30, the second storage compartment 31, and the third storage compartment 32 are not limited thereto.

The refrigerator 1 may include a refrigerating compartment and a freezing compartment. Depending on the type of refrigerator 1, the upper first storage compartment 30 may be provided as the refrigerating compartment, and the lower second storage compartment 31 and third storage compartment 32 may be provided as the freezing compartments. However, the positions of the refrigerating compartment and the freezing compartments are not limited thereto.

The refrigerator 1 illustrated in FIG. 1 is the refrigerator 1 in which the first storage compartment 30 positioned at the upper portion is provided as the refrigerating compartment, and the second storage compartment 31 and the third storage compartment 32 positioned at the lower portion are provided as the freezing compartments. The refrigerating compartment may be kept at approximately 3 degrees Celsius and the freezing compartments may be kept at approximately minus 20 degrees Celsius according to exemplary embodiments The first storage compartment 30, the second storage compartment 31, and the third storage compartment 32 may be opened and closed by doors, such as a first door 20, a second door 21, a third door 22, and a fourth door 23. The first storage compartment 30 may be opened and closed by the first door 20 and the second door 21 rotatably coupled to the main body 10. The second storage compartment 31 may be opened and closed by the third door 22 rotatably coupled to the main body 10. The third storage compartment 32 may be opened and closed by the fourth door 23 rotatably coupled to the main body 10. However, the present disclosure is not limited thereto, and the doors, such as the first door 20, the second door 21, the third door 22, and the fourth door 23 may be provided in various forms as long as they may open and close the storage compartments, such as the first storage compartment 30, the second storage compartment 31, and the third compartment 32.

A plurality of door guards 40 capable of storing objects and the like may be provided on rear surfaces of the first door 20, the second door 21, the third door 22, and the fourth door 23. The door guard 40 may be provided to accommodate objects and the like having small volume.

The refrigerator 1 may include a cooling system provided to supply cold air to the first storage compartment 30, the second storage compartment 31, and the third compartment 32.

The cooling system may include a compressor, a condenser, an expansion valve, an evaporator, and a blowing fan. This cooling system may be disposed in a machine room provided at a lower rear side of the main body 10.

Figure 2:
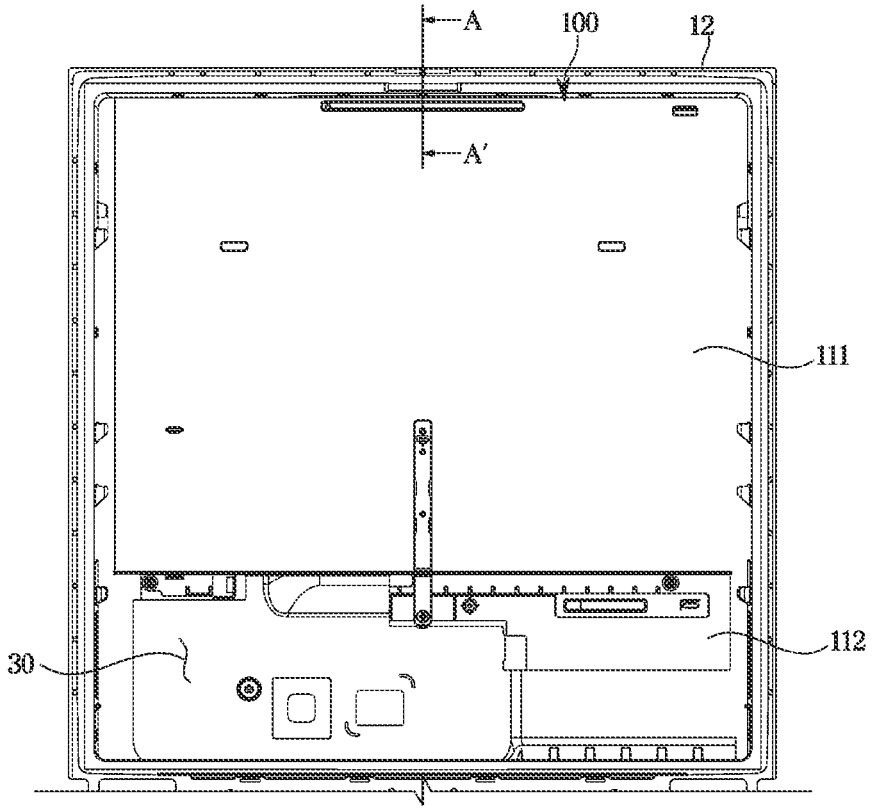
FIG. 2 is a front view illustrating that a duct is mounted on an inner case in a first storage compartment of the refrigerator according to an embodiment of the present disclosure.

The refrigerator 1 may include a duct 100, such as in FIG. 2 provided to flow cold air generated through the cooling system into the first storage compartment 30, the second storage compartment 31, and the third compartment 32. These aspects will be described further below.

FIG. 2 is a front view illustrating that the duct 100 is mounted on the inner case in the first storage compartment 30 of the refrigerator 1 according to an embodiment of the present disclosure.

As illustrated in FIG. 2, the duct 100 may be mounted on the inner case 12 of the refrigerator 1. The duct 100 may be provided in the first storage compartment 30.

The duct 100 may be mounted on the inner case 12 to form a flow path for supplying cold air to the storage compartment 30. The duct 100 may be coupled to a rear surface of the inner case 12. Therefore, when a user opens the first door 20 or the second door 21, the duct 100 may be disposed forward to face the user. More specifically, a front cover 111 of the duct 100 may be seen in a field of view of the user by being disposed to be exposed to the storage compartment.

A plurality of shelves may be disposed in the inner case 12. The plurality of shelves may be disposed in front of the duct 100 to store objects.

The duct 100 of the refrigerator 1 according to an embodiment of the present disclosure may be mounted on the rear surface of the inner case 12 to cover most of the rear surface. A surface of the duct 100 may be provided to be flat. However, a shape of the surface of the duct 100 is not limited thereto.

Figure 3:
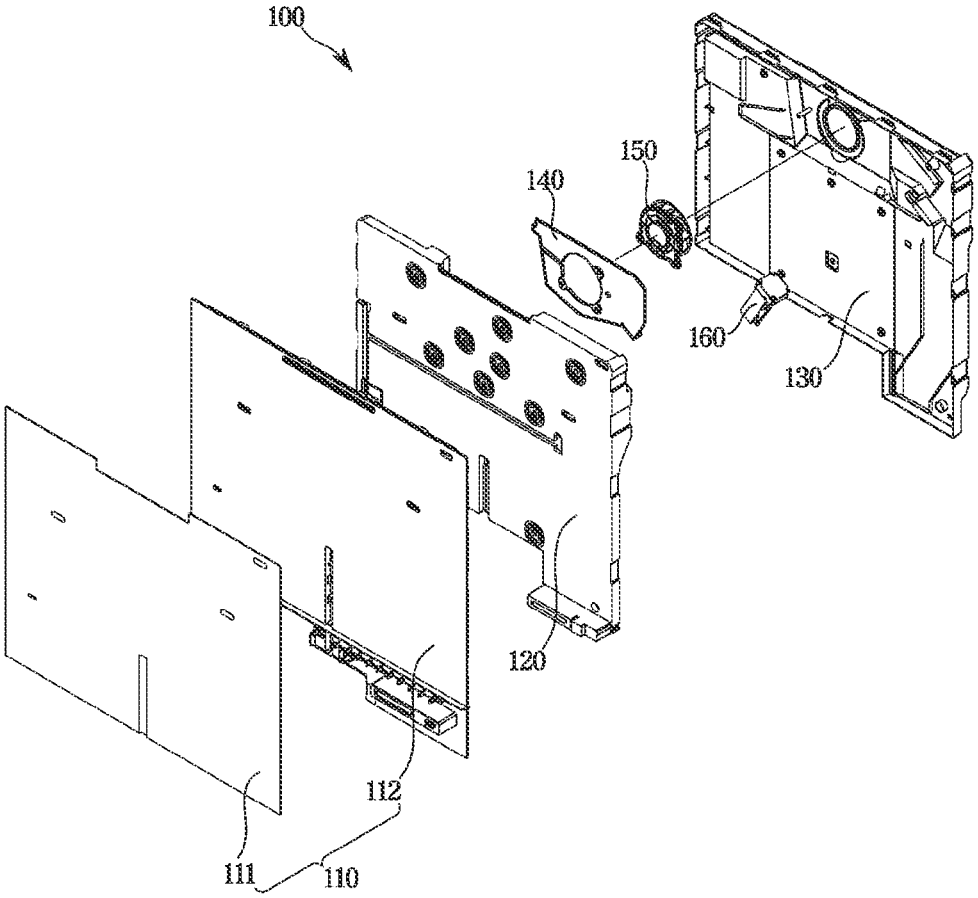
FIG. 3 is an exploded perspective view of the duct of the refrigerator according to an embodiment of the present disclosure.

FIG. 3 is an exploded perspective view of the duct of the refrigerator according to an embodiment of the present disclosure.

As illustrated in FIG. 3, the duct 100 may include a cover unit 110 (which may be referred to as a cover), a heat insulating member 120 and a rear plate 130.

The cover unit 110 may be disposed in front of the duct 100. The cover unit 110 may include the front cover 111 and a support plate 112 supporting the front cover 111.

The front cover 111, which is a component positioned at the most front of the duct 100, may be disposed to be exposed to the storage compartment. The front cover 111 may be detachably provided on the support plate 112. Accordingly, as a design of the front cover 111 is freely changed, an exterior design of the duct 100 and an interior design of the refrigerator may be implemented differently.

That is, the front cover 111 may form a front exterior of the duct 100 by being exposed to the storage compartment 30.

The support plate 112 may be provided to fix the front cover 111. The support plate 112 may be provided to support the front cover 111 at the rear thereof. A part of the support plate 112 may also be provided to be exposed to the storage compartment 30. More specifically, an upper portion of the support plate 112 may be covered by the front cover 111, and a lower portion of the support plate 112 may be exposed to the storage compartment 30.

A plurality of sensors may be mounted on the support plate 112. The plurality of sensors may be a temperature sensor and a humidity sensor. In addition, a plurality of deodorizers may be attached to the support plate 112 to deodorize the inside of the refrigerator.

Although the cover unit 110 of the refrigerator 1 according to an embodiment of the present disclosure has been described as having separate components, the cover unit 110 may be integrally formed.

The duct 100 may include the heat insulating member 120 mounted at the rear of the support plate 112. The heat insulating member 120 may be provided to block warm air in the refrigerator and cold air generated through the cooling system. The heat insulating member 120 may be made of a material such as urethane foam, but is not limited thereto.

The duct 100 may include a rear plate 130 coupled to the cover unit 110. The rear plate 130 may be provided to form a flow path through which cold air flows. More specifically, the rear plate 130 may be coupled to the support plate 112 to form a flow path through which cold air flows between the rear plate 130 and the support plate 112.

The duct 100 may include a fan 150, an air guide 140, and a damper 160.

The fan 150 may be mounted on the rear plate 130. The fan 150 may be provided to assist a flow of cold air generated by the cooling system.

The air guide 140 may be provided to form a circulation flow path through which cold air around the fan 150 smoothly flows. The air guide 140 may also be provided to fix a position of the fan 150. The air guide 140 as described above may be designed such that an appropriate flow pressure is formed around the fan 150. The air guide 140 may be mounted on the rear plate 130 together with the fan 150.

The damper 160 may be mounted on the rear plate 130. The damper 160 may be provided to vary a cross-sectional area inside a flow path through which cold air flows. The damper 160 may be provided to adjust a supply amount of cold air to be supplied to the storage compartment by being controlled depending on a set temperature in the refrigerator.

Figure 4:
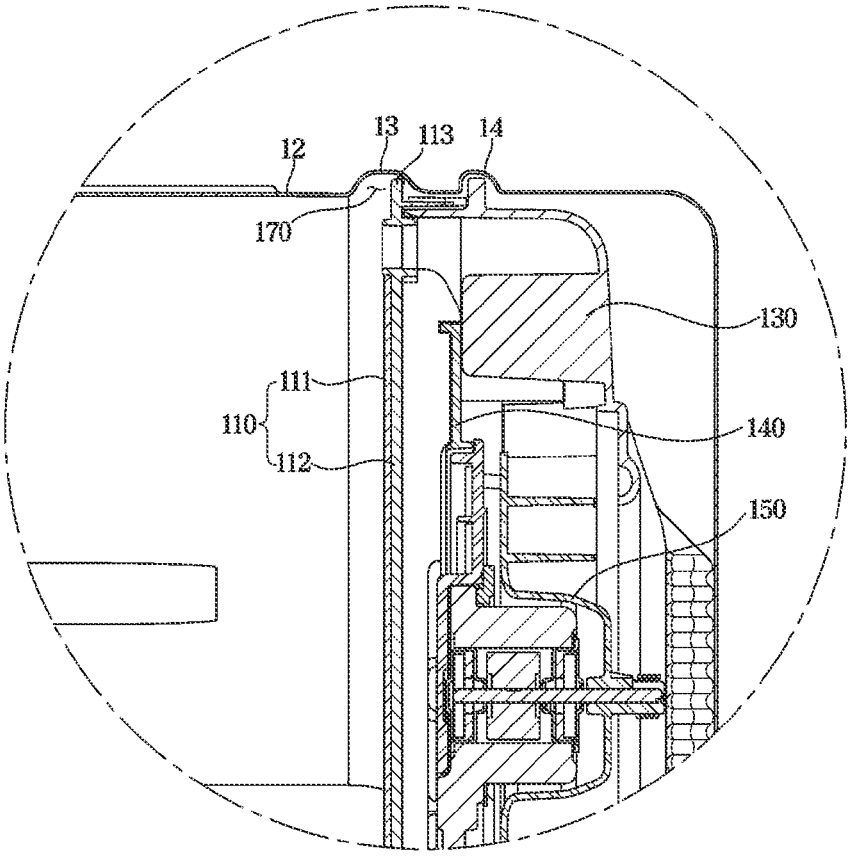
FIG. 4 is an enlarged upper cross-sectional view taken along a line A-A" in FIG. 2.

FIG. 4 is an enlarged upper cross-sectional view taken along line A-A" in FIG. 2.

As illustrated in FIG. 4, the duct 100 may be mounted on the inner case 12. The duct 100 may also be mounted on the inner case 12 by a separate fastening member. More specifically, a fastening member may be coupled at the rear of the inner case 12 so that the duct 100 and the inner case 12 may be coupled. However, a fastening direction and fastening method of the fastening member are not limited thereto. Through this, an upper end of the duct 100 may be mounted to be spaced apart from an upper surface of the inner case 12.

The inner case 12 may include accommodating grooves, such as a first accommodating groove 13 and a second accommodating groove 14. The first accommodating groove 13 and the second accommodating groove 14 may be formed on the upper surface of the inner case 12. The first accommodating groove 13 and the second accommodating groove 14 may be formed to be recessed from the upper surface of the inner case 12 toward the outer case 11, such as in FIG. 1. In other words, the first accommodating groove 13 and the second accommodating groove 14 may be formed to be depressed inward from the upper surface of the inner case 12.

One end of the duct 100 may be accommodated in the first accommodating groove 13. Another end of the duct 100 may be accommodated in the second accommodating groove 14.

The second accommodating groove 14 may be formed at the rear of the first accommodating groove 13. More specifically, an upper end of the cover unit 110 may be accommodated in the first accommodating groove 13. In addition, an upper end of the rear plate 130 may be accommodated in the second accommodating groove 14. However, because the second accommodating groove 14 is provided to correspond to a shape of the rear plate 130, the second accommodating groove 14 does not necessarily need to be formed such as in a case where the shape and arrangement of the rear plate 130 would not be extended into such groove.

The duct 100 may be mounted on the inner case 12. More specifically, the duct 100 may be mounted on the rear surface of the inner case 12. The duct 100 may be disposed in a vertical direction with respect to a bottom surface of the storage compartment 30. Therefore, the duct 100 may form a portion of the rear of the storage compartment 30.

One end of the duct 100 may be disposed in the first accommodating groove 13 to be spaced apart from a surface of the first accommodating groove 13. More specifically, the upper end of the duct 100 may be disposed in the first accommodating groove 13 to be spaced apart from the surface of the first accommodating groove 13. In addition, an inner side surface of the first accommodating groove 13 and a front surface of the duct 100 may be provided to be spaced apart from each other in a front-rear direction.

Specifically, the cover unit 110 of the duct 100 may be provided such that one end thereof may be inserted into the first accommodating groove 13. The duct 100 may include an invisible portion 113 formed at the upper end of the cover unit 110. That is, the invisible portion 113 of the cover unit 110 may be provided to be inserted into the first accommodating groove 13.

The invisible portion 113 may be provided not to be exposed to the outside by being inserted into the first accommodating groove 13. Through this, an assembly gap generated between the duct 100 and the inner case 12 may not be exposed to the outside. The meaning of not being exposed to the outside means that when a user opens the door, it is not exposed to a field of view of the user.

In the related art, the refrigerator 1 is manufactured in such a way as to minimize an assembly gap in order to prevent the aesthetics of the refrigerator from deteriorating due to the assembly gap between the duct 100 and the inner case 12.

However, as long as the duct 100 and the inner casing 12 are provided as separate components, it was found to be impossible to completely eliminate the assembly gap, and an overall manufacturing process would have been unnecessarily lengthened by taking effort and time to minimize the assembly gap.

Accordingly, the structure of the refrigerator 1 according to an embodiment of the present disclosure is improved such that one end of the duct 100 is inserted into the accommodating groove 13 of the inner case 12 so that the assembly gap between the duct 100 and the inner case 12 is hidden. That is, the structure is improved by forming the invisible portion 113 in the duct 100 so that the user does not recognize the assembly gap.

Through this, the refrigerator 1 according to an embodiment of the present disclosure does not require extra effort to minimize the assembly gap in the manufacturing process, and as a result, a production cycle of the refrigerator 1 may be improved.

The refrigerator 1 may include a separation space 170 formed between a front surface of the cover unit 110 and the inner side surface of the first accommodating groove 13.

The inner side surface of the first accommodating groove 13 and the front surface of the duct 100 may be provided to be spaced apart from each other in the front-rear direction. More specifically, the separation space 170 may be formed between a front surface of the invisible portion 113 formed at the upper end of the cover unit 110 and the inner side surface of the first accommodating groove 13.

As the separation space 170 is formed between the upper end of the duct 100 and the first accommodating groove 13 of the inner case 12, when the user views the storage compartment from the front, constant shades may be formed at the upper end of the duct 100. More specifically, constant shades may be formed at the upper end of the cover unit 110. Therefore, the overall aesthetics of the inside of the refrigerator may be improved.

In addition, a lighting device or the like may be installed on the inner side surface of the first accommodating groove 13 of the inner case 12 to illuminate a portion where the duct 100 and the inner case 12 are connected. Through this, the aesthetics of the inside of the refrigerator may be further improved, and more constant shades may be implemented at a boundary line.

In addition, because the separation space 170 is formed between the upper end of the duct 100 and the first accommodating groove 13 of the inner case 12, even when a design of the cover unit 110 of the duct 100 is changed, a design of the inner case 12 does not need to be changed.

For example, if there were no free space when the duct 100 is coupled to the inner case 12, when the design of the front cover 111 of the duct 100 is changed, the inner case 12 on which the duct 100 is mounted would also have to be re-injected depending on the design of the front cover 111, which would be inconvenient.

However, by forming the separation space 170 between the duct 100 and the inner case 12 like the refrigerator 1 according to an embodiment of the present disclosure, the design of the cover unit 110 of the duct 100 may be freely changed, and accordingly, the design of the inner case 12 may not need to be changed. Through this, a manufacturing cost and production cost of the product may be reduced.

Figure 5:
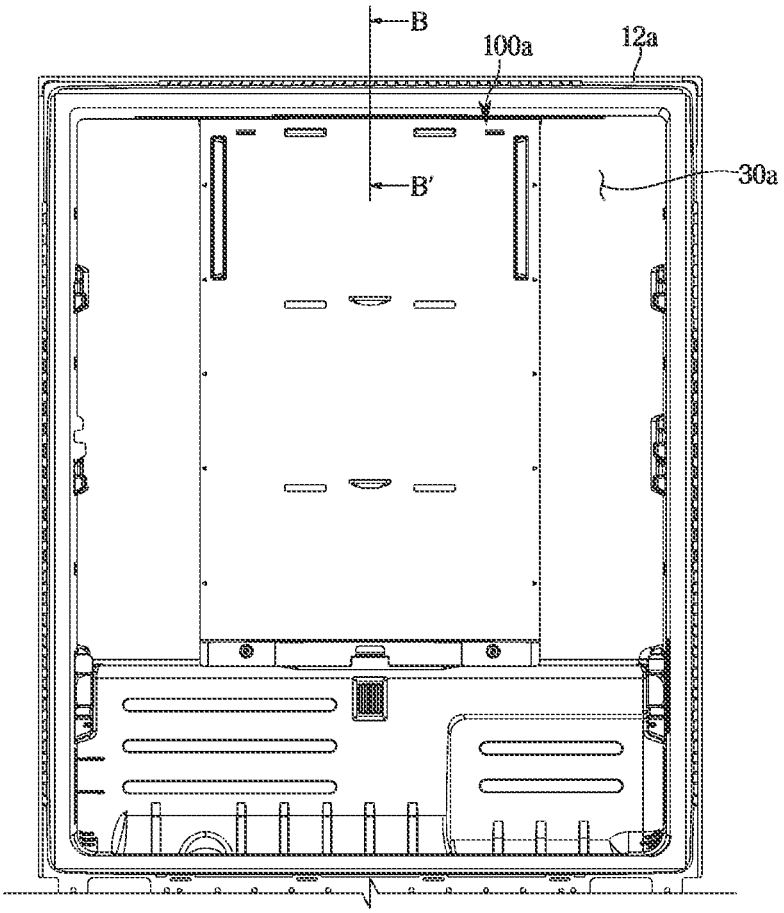
FIG. 5 is a front view illustrating that a duct is mounted on an inner case in a first storage compartment of the refrigerator according to another embodiment of the present disclosure.
Figure 6:
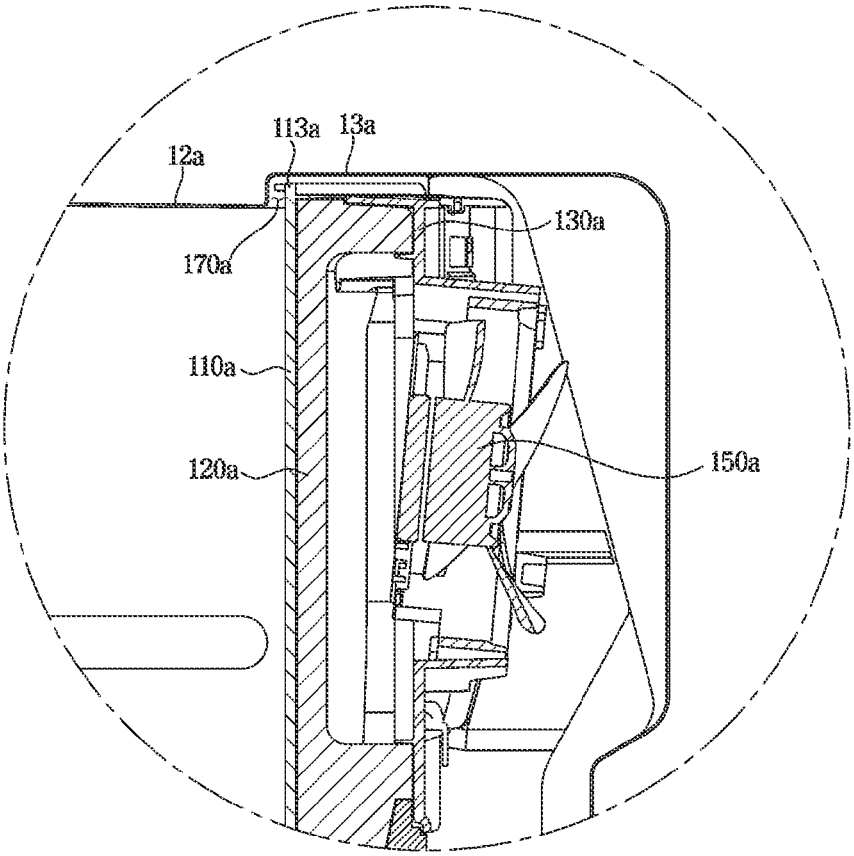
FIG. 6 is an enlarged upper cross-sectional view taken along a line B-B' in FIG. 5.

FIG. 5 is a front view illustrating that a duct is mounted on an inner case in a first storage compartment of the refrigerator according to another embodiment of the present disclosure. FIG. 6 is an enlarged upper cross-sectional view taken along line B-B' in FIG. 5.

Referring to FIG. 5, a duct 100*a* may be mounted on an inner case 12*a* of a refrigerator according to another embodiment of the present disclosure. The duct 100*a* may be provided in a first storage compartment 30*a*. Hereinafter, contents different from those of the refrigerator according to an embodiment of the present disclosure will be mainly described. Configurations not separately described may be provided to be the same as the configurations of the refrigerator according to an embodiment of the present disclosure, and the same reference numerals may be used.

Unlike the duct 100 of the refrigerator according to an embodiment of the present disclosure, the duct 100*a* of the refrigerator according to another embodiment of the present disclosure may be mounted on a rear surface of the inner case 12*a* to cover a central portion of the rear surface. A surface of the duct 100*a* may be provided to have a certain curvature.

The duct 100*a* may be mounted on the inner case 12*a* to form a flow path for supplying cold air to the storage compartment 30*a*. The duct 100*a* may be coupled to the rear surface of the inner case 12*a*. Therefore, when a user opens the first door 20 or the second door 21, the duct 100*a* may be disposed forward to face the user. More specifically, a cover unit 110*a* of the duct 100*a* may be seen in a field of view of the user by being disposed to be exposed to the storage compartment 30*a*.

A plurality of shelves may be disposed in the inner case 12*a*. The plurality of shelves may be disposed in front of the duct 100*a* to store objects.

As illustrated in FIG. 6, the duct 100*a* may be mounted on the inner case 12*a*. The duct 100*a* may be mounted on the inner case 12*a* by a separate fastening member. More specifically, a fastening member is coupled at the rear of the inner case 12*a* so that the duct 100*a* and the inner case 12*a* may be coupled. However, a fastening direction and fastening method of the fastening member are not limited thereto.

The inner case 12*a* may include an accommodating groove 13*a*. The accommodating groove 13*a* may be formed on an upper surface of the inner case 12*a*. The accommodating groove 13*a* may be formed to be recessed from the upper surface of the inner case 12*a* toward the outer case 11, such as in FIG. 1. In other words, the accommodating groove 13*a* may be formed to be depressed inward from the upper surface of the inner case 12*a*.

Unlike the accommodating groove 13*a* according to an embodiment of the present disclosure, the accommodating groove 13*a* according to another embodiment of the present disclosure may be formed singly to accommodate an entire upper end of the duct 100*a*.

The duct 100*a* may be mounted on the inner case 12*a*. More specifically, the duct 100*a* may be mounted on the rear surface of the inner case 12*a*. The duct 100*a* may be disposed in a vertical direction with respect to a bottom surface of the storage compartment 30*a*. Therefore, the duct 100*a* may form a portion of the rear of the storage compartment 30*a*.

One end of the duct 100*a* may be disposed in the accommodating groove 13*a* to be spaced apart from a surface of the accommodating groove 13*a*. More specifically, the upper end of the duct 100*a* may be disposed in the accommodating groove 13*a* to be spaced apart from the surface of the accommodating groove 13*a*. In addition, an inner side surface of the accommodating groove 13*a* and a front surface of the duct 100*a* may be provided to be spaced apart from each other in a front-rear direction.

Specifically, the duct 100*a* may include an invisible portion 113*a* formed at an upper end of the cover unit 110*a*. That is, the invisible portion 113*a* of the cover unit 110*a* may be provided to be inserted into the accommodating groove 13*a*.

The invisible portion 113*a* may be provided not to be exposed to the outside by being inserted into the accommodating groove 13*a*. Through this, an assembly gap generated between the duct 100*a* and the inner case 12*a* may not be exposed to the outside. The meaning of not being exposed to the outside means that when a user opens the door, it is not exposed to a field of view of the user.

Accordingly, the structure of the refrigerator according to another embodiment of the present disclosure is improved such that one end of the duct 100*a* is inserted into the accommodating groove 13*a* of the inner case 12*a* so that the assembly gap between the duct 100*a* and the inner case 12*a* is hidden. That is, the structure is improved by forming the invisible portion 113*a* in the duct 100*a* so that the user does not recognize the assembly gap.

Through this, the refrigerator according to another embodiment of the present disclosure does not require extra effort to minimize the assembly gap in a manufacturing process, and as a result, a production cycle of the refrigerator may be improved.

The refrigerator may include a separation space 170*a* formed between a front surface of the cover unit 110*a* and the inner side surface of the first accommodating groove 13*a*.

The inner side surface of the accommodating groove 13*a* and the front surface of the duct 100*a* may be provided to be spaced apart from each other in the front-rear direction. More specifically, the separation space 170*a* may be formed between a front surface of the invisible portion 113*a* formed at the upper end of the cover unit 110*a* and the inner side surface of the accommodating groove 13*a*.

As the separation space 170*a* is formed between the upper end of the duct 100*a* and the accommodating groove 13*a* of the inner case 12*a*, when the user views the storage compartment 30*a* from the front, constant shades may be formed at the upper end of the duct 100*a*. More specifically, constant shades may be formed at the upper end of the cover unit 110*a*. Therefore, the overall aesthetics of the inside of the refrigerator may be improved.

In addition, a lighting device or the like may be installed on the inner side surface of the accommodating groove 13*a* of the inner case 12*a* to illuminate a portion where the duct 100*a* and the inner case 12*a* are connected. Through this, the aesthetics of the inside of the refrigerator may be further improved, and more constant shades may be implemented at a boundary line.

In addition, because the separation space 170*a* is formed between the upper end of the duct 100*a* and the accommodating groove 13*a* of the inner case 12*a*, even when a design of the cover unit 110*a* of the duct 100*a* is changed, a design of the inner case 12*a* does not need to be changed.

For example, if there were no free space when the duct 100*a* is coupled to the inner case 12*a*, when the design of the cover unit 110*a* of the duct 100*a* is changed, the inner case 12*a* on which the duct 100*a* is mounted also has to be re-injected depending on the design of the cover unit 110*a*, which would be inconvenient.

However, by forming the separation space 170*a* between the duct 100*a* and the inner case 12*a* like the refrigerator according to an embodiment of the present disclosure, the design of the cover unit 110*a* of the duct 100*a* may be freely changed, and accordingly, the design of the inner case 12*a* may not need to be changed. Through this, a manufacturing cost and production cost of the product may be reduced.

Figure 7:
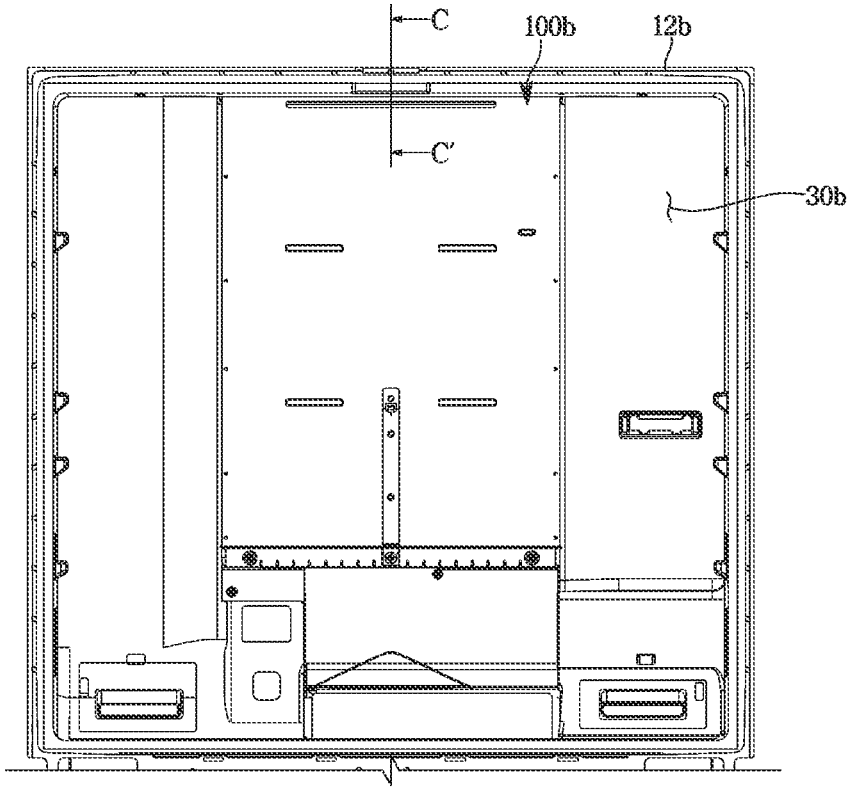
FIG. 7 is a front view illustrating that a duct is mounted on an inner case in a first storage compartment of the refrigerator according to another embodiment of the present disclosure.
Figure 8:
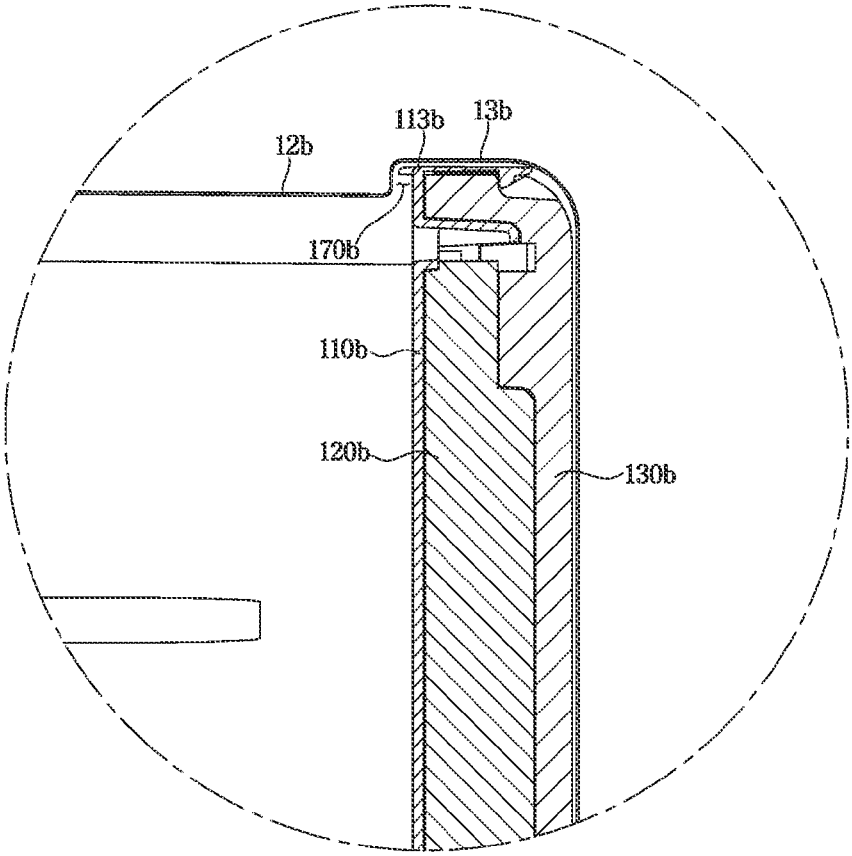
FIG. 8 is an enlarged upper cross-sectional view taken along a line C-C' in FIG. 7.

FIG. 7 is a front view illustrating that a duct is mounted on an inner case in a first storage compartment of the refrigerator according to an embodiment of the present disclosure. FIG. 8 is an enlarged upper cross-sectional view taken along line C-C' in FIG. 7.

Referring to FIG. 7, a duct 100*b* may be mounted on an inner case 12*b* of a refrigerator according to an embodiment of the present disclosure. The duct 100*b* may be provided in a first storage compartment 30*b*.

Hereinafter, contents different from those of the refrigerators according to an embodiments of the present disclosure will be mainly described. Configurations without additional explanation may be provided identically to the configurations of the refrigerator according to an embodiment of the present disclosure, and the same reference numerals may be used.

Unlike the duct 100 of the refrigerator according to an embodiment of the present disclosure, the duct 100*b* of the refrigerator according to an embodiment of the present disclosure may be mounted on a rear surface of the inner case 12*b* to cover a central portion of the rear surface. Also, unlike the duct 100*a* of the refrigerator according to an embodiment of the present disclosure, a surface of the duct 100*b* of the refrigerator according to an embodiment of the present disclosure may be provided to be flat.

The duct 100*b* may be mounted on the inner case 12*b* to form a flow path for supplying cold air to the storage compartment 30*b*. The duct 100*b* may be coupled to the rear surface of the inner case 12*b*. Therefore, when a user opens the first door or the second door, the duct 100*b* may be disposed forward to face the user. More specifically, a cover unit 110*b* of the duct 100*b* may be seen in a field of view of the user by being disposed to be exposed to the storage compartment 30*b*.

A plurality of shelves may be disposed in the inner case 12*b*. The plurality of shelves may be disposed in front of the duct 100*b* to store objects.

As illustrated in FIG. 8, the duct 100*b* may be mounted on the inner case 12*b*. The duct 100*b* may be mounted on the inner case 12*b* by a separate fastening member. More specifically, a fastening member is coupled at the rear of the inner case 12*b* so that the duct 100*b* and the inner case 12*b* may be coupled. However, a fastening direction and fastening method of the fastening member are not limited thereto.

The inner case 12*b* may include an accommodating groove 13*b*. The accommodating groove 13*b* may be formed on an upper surface of the inner case 12*b*. The accommodating groove 13*b* may be formed to be recessed from the upper surface of the inner case 12*b* toward the outer case 11, such as in FIG. 1. In other words, the accommodating groove 13*b* may be formed to be depressed inward from the upper surface of the inner case 12*b*.

Unlike the accommodating groove 13 according to an embodiment of the present disclosure, the accommodating groove 13*b* according to an embodiment of the present disclosure is formed singly to accommodate an entire upper end of the duct 100*b*.

The duct 100*b* may be mounted on the inner case 12*b*. More specifically, the duct 100*b* may be mounted on the rear surface of the inner case 12*a*. The duct 100*a* may be disposed in a vertical direction with respect to a bottom surface of the storage compartment 30*b*. Therefore, the duct 100*b* may form a portion of the rear of the storage compartment 30*b*.

One end of the duct 100*b* may be disposed in the accommodating groove 13*b* to be spaced apart from a surface of the accommodating groove 13*b*. More specifically, the upper end of the duct 100*b* may be disposed in the accommodating groove 13*b* to be spaced apart from the surface of the accommodating groove 13*b*. In addition, an inner side surface of the accommodating groove 13*b* and a front surface of the duct 100*b* may be provided to be spaced apart from each other in a front-rear direction.

Specifically, the duct 100*b* may include an invisible portion 113*b* formed at an upper end of the cover unit 110*b*. That is, the invisible portion 113*b* of the cover unit 110*b* may be provided to be inserted into the accommodating groove 13*b*.

The invisible portion 113*b* may be provided not to be exposed to the outside by being inserted into the accommodating groove 13*b*. Through this, an assembly gap generated between the duct 100*b* and the inner case 12*b* may not be exposed to the outside. The meaning of not being exposed to the outside means that when a user opens the door, it is not exposed to a field of view of the user.

Accordingly, the structure of the refrigerator according to an embodiment of the present disclosure is improved such that one end of the duct 100*b* is inserted into the accommodating groove 13*b* of the inner case 12*b* so that the assembly gap between the duct 100*b* and the inner case 12*b* is hidden. That is, the structure is improved by forming the invisible portion 113*b* in the duct 100*b* so that the user does not recognize the assembly gap.

Through this, the refrigerator according to an embodiment of the present disclosure does not require extra effort to minimize the assembly gap in a manufacturing process, and as a result, a production cycle of the refrigerator may be improved.

The refrigerator may include a separation space 170*b* formed between a front surface of the cover unit 110*b* and the inner side surface of the first accommodating groove 13*b*.

The inner side surface of the accommodating groove 13*b* and the front surface of the duct 100*b* may be provided to be spaced apart from each other in the front-rear direction. More specifically, the separation space 170*b* may be formed between a front surface of the invisible portion 113*b* formed at the upper end of the cover unit 110*b* and the inner side surface of the accommodating groove 13*b*.

As the separation space 170*b* is formed between the upper end of the duct 100*b* and the accommodating groove 13*b* of the inner case 12*b*, when the user views the storage compartment 30*b* from the front, constant shades may be formed at the upper end of the duct 100*b*. More specifically, constant shades may be formed at the upper end of the cover unit 110*b*. Therefore, the overall aesthetics of the inside of the refrigerator may be improved.

In addition, a lighting device or the like may be installed on the inner side surface of the accommodating groove 13*b* of the inner case 12*b* to illuminate a portion where the duct 100*b* and the inner case 12*b* are connected. Through this, aesthetics of the inside of the refrigerator may be further improved, and more constant shades may be implemented at a boundary line.

In addition, because the separation space 170*b* may be formed between the upper end of the duct 100*b* and the accommodating groove 13*b* of the inner case 12*b*, even when a design of the cover unit 110*b* of the duct 100*b* is changed, a design of the inner case 12*b* does not need to be changed.

For example, if there were no free space when the duct 100*b* is coupled to the inner case 12*b*, when the design of the cover unit 110*b* of the duct 100*b* is changed, the inner case 12*b* on which the duct 100*b* is mounted would also have to be re-injected depending on the design of the cover unit 110*b*, which would be inconvenient.

However, by forming the separation space 170*b* between the duct 100*b* and the inner case 12*b* like the refrigerator according to an embodiment of the present disclosure, the design of the cover unit 110*b* of the duct 100*b* may be freely changed, and accordingly, the design of the inner case 12*b* may not need to be changed. Through this, a manufacturing cost and production cost of the product may be reduced.

The foregoing has illustrated and described specific embodiments. However, it should be understood by those of skilled in the art that the disclosure is not limited to the above-described embodiments, and various changes and modifications may be made without departing from the technical idea of the disclosure described in the following claims.

What is claimed is:

1. A refrigerator comprising:

an inner case defining a storage compartment;

an outer case coupled to an outside of the inner case; and a duct mounted to the inner case and configured to provide a flow path to supply air to the storage compartment, wherein the duct comprises:

a cover; and a rear plate coupled to the cover to form the flow path between the rear plate and the cover, wherein the inner case comprises:

a first accommodating groove formed on an upper surface of the inner case that is recessed from an inside of the inner case to the outside of the inner case and toward an inside of the outer case; and a second accommodating groove provided at a rear of the first accommodating groove, wherein an upper end of the cover is disposed in the first accommodating groove and is spaced apart from an inner front surface of the first accommodating groove, wherein the upper end of the cover disposed in the first accommodating groove is not visible from the storage compartment, and wherein a separation space is provided between the upper end of the cover and the inner front surface of the first accommodating groove such that the upper end of the cover is disposed closer to an inner rear surface of the first accommodating groove than the inner front surface of the first accommodating groove.

2. The refrigerator according to claim 1, wherein the cover comprises:

a front cover exposed to the storage compartment and forming a front exterior of the duct; and a support plate supporting the front cover.

3. The refrigerator according to claim 2, wherein the front cover is configured to be detachable from the support plate.

4. The refrigerator according to claim 2, wherein the rear plate is coupled to the support plate and configured to provide a portion of the flow path configured to supply the air between the rear plate and the support plate.

5. The refrigerator according to claim 1, wherein the duct is coupled to the inner case by a fastening member coupled at a rear of the inner case.

6. The refrigerator according to claim 1, wherein the duct is mounted on a rear surface of the inner case and covers a central portion of the rear surface.

7. The refrigerator according to claim 1, wherein the duct is mounted on a rear surface of the inner case and covers a majority of the rear surface.

8. The refrigerator according to claim 1, wherein the rear plate comprises an upper end portion disposed in the second accommodating groove.

9. The refrigerator according to claim 1, wherein the duct is disposed in a vertical direction with respect to a bottom surface of the storage compartment.

10. The refrigerator according to claim 1, wherein the inner front surface of the first accommodating groove is spaced apart from a front surface of the duct in a front-rear direction.

11. The refrigerator according to claim 1, wherein the inner case comprises plastic, and the outer case comprises metal.

12. The refrigerator according to claim 1, further comprising an insulating material between the inner case and the outer case.

13. The refrigerator according to claim 1, wherein the outer case comprises one or more doors configured to open to an inside of the storage compartment of the inner case, wherein, in a first direction in which the first accommodating groove is recessed from the inside of the inner case to the outside of the inner case and toward the outer case, one end of the duct is a longitudinal end of the duct closest to the outer case, and wherein, in a second direction which is perpendicular to the first direction and is a direction in which the one or more doors open to the inside of the storage compartment of the inner case, the one end of the duct is hidden by the first accommodating groove.

* * * * *